United States Patent [19]

McElroy

[11] 3,984,083

[45] Oct. 5, 1976

[54] SECONDARY OVERSPEED BRAKE FOR CABLE CLIMBER

[75] Inventor: Robert C. McElroy, Lisbon, Ohio

[73] Assignee: Cable Climber Safety Devices, Incorporated, Lisbon, Ohio

[22] Filed: Sept. 10, 1974

[21] Appl. No.: 504,816

[52] U.S. Cl. ..... 254/156; 188/188

[51] Int. Cl.[2] ..... B66D 5/16

[58] Field of Search ..... 254/156, 157, 154, 167; 188/188, 189, 65.2, 65.4, 136, 44; 242/107.3

[56] References Cited

UNITED STATES PATENTS

| | | | |
|---|---|---|---|
| 494,407 | 3/1893 | Bradley | 254/157 |
| 1,165,583 | 12/1915 | Farmer | 188/189 |
| 2,791,397 | 5/1957 | Coffman | 254/157 |
| 3,327,811 | 6/1967 | Mastroberte | 188/188 |
| 3,333,822 | 8/1967 | Horvath | 254/156 |
| 3,830,346 | 8/1974 | Watts | 188/188 |

*Primary Examiner*—Robert J. Spar
*Assistant Examiner*—Kenneth Noland
*Attorney, Agent, or Firm*—Blair & Brown

[57] ABSTRACT

The secondary overspeed assembly for a cable climber or hoist is provided that includes an overspeed sensor assembly. The sensor assembly consists of a bar with a pair of members or weights whose movement is restricted by a spring member, and wherein these weights can move outward only at an overspeed condition.

3 Claims, 4 Drawing Figures

48
47
42
39
59"
45
68
40
41
55
60
42
50
51
52
53
54
56
36
37
67
58

SECONDARY OVERSPEED BRAKE FOR CABLE CLIMBER

BACKGROUND OF THE INVENTION

FIELD OF THE INVENTION

The present invention relates to cable climbers or hoists, and particularly to a secondary overspeed brake mechanism for such a cable climber.

SUMMARY OF THE INVENTION

A cable climber secondary overspeed brake is provided that includes an overspeed sensor assembly that will be actuated only at an overspeed condition. Under certain conditions any climber movement downward causes a cam to compress against the cable to stop the climber from moving any further. An operating handle is provided for operating the cable climber either up or down depending on the position of the direction switch.

The primary object of the present invention is to provide a cable climber secondary overspeed brake that includes a sensor assembly that will be actuated only during overspeed conditions.

Other objects and advantages will become apparent in the following specification when considered in light of the attached drawings.

DESCRIPTION OF THE PREFERRED EMBODIMENT

Figure 1:
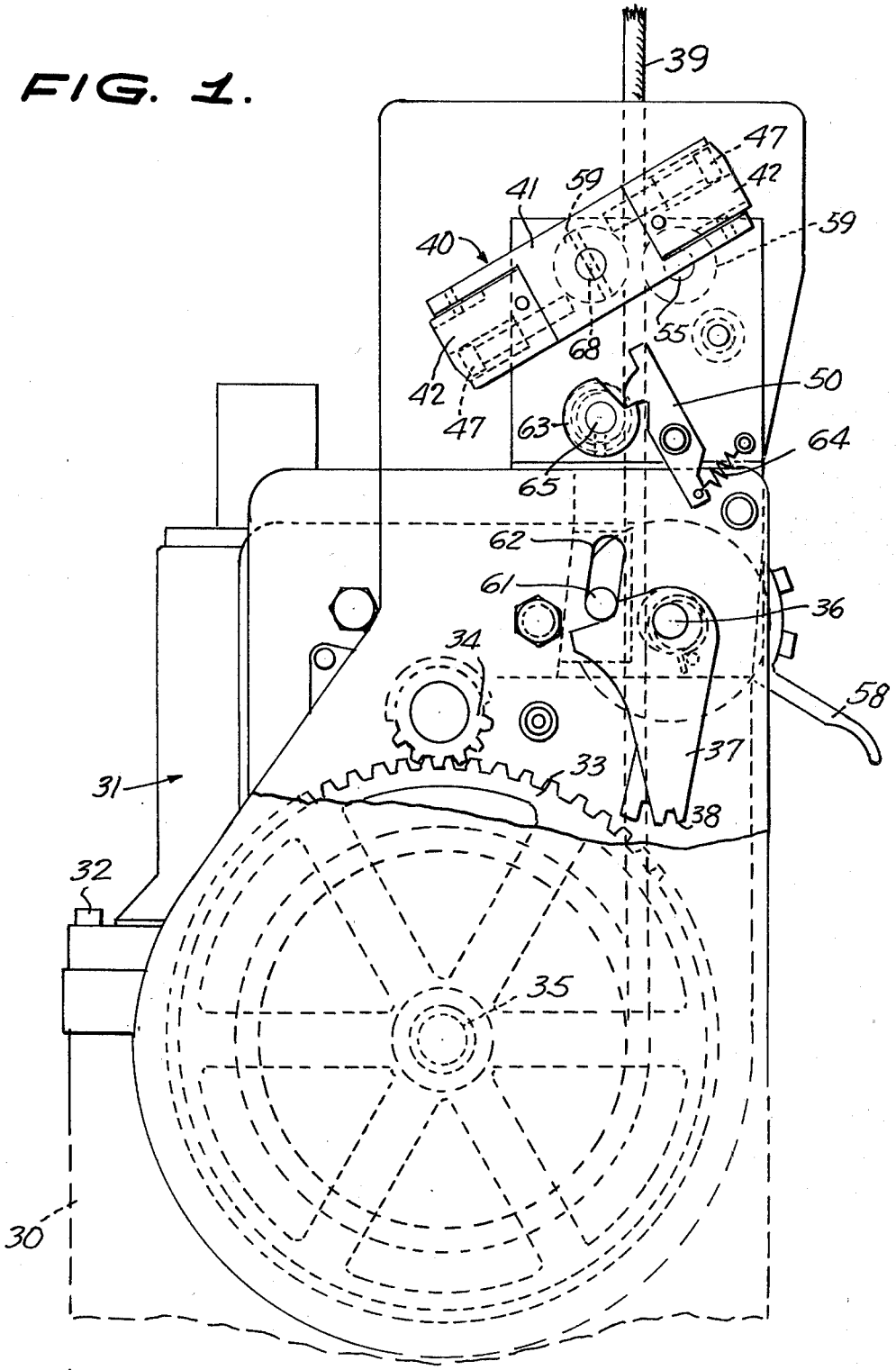
FIG. 1 is an elevational view illustrating a cable climber equipped with the secondary overspeed brake of the present invention, and with parts broken away for clarity of illustration.

Referring now to the drawings in detail, wherein like reference characters indicate like parts throughout the several FIGURES, the reference numeral 30 indicates a portion of an electric motor having a gear drive 31 mounted thereon, as shown in FIG. 1. The gear drive 31 is secured in place by bolts 32.

As shown in the drawings the numeral 33 indicates a ring gear that has a pinion 34 arranged in meshing arrangement therewith. The ring gear 33 has a shaft 35 fixedly connected thereto.

A pawl 37 is connected to a shaft 36, and has teeth 38 on an end thereof which are arranged adjacent the ring gear 33. The numeral 39 indicates the cable for the electric hoist or climber.

Figures 2, 4:
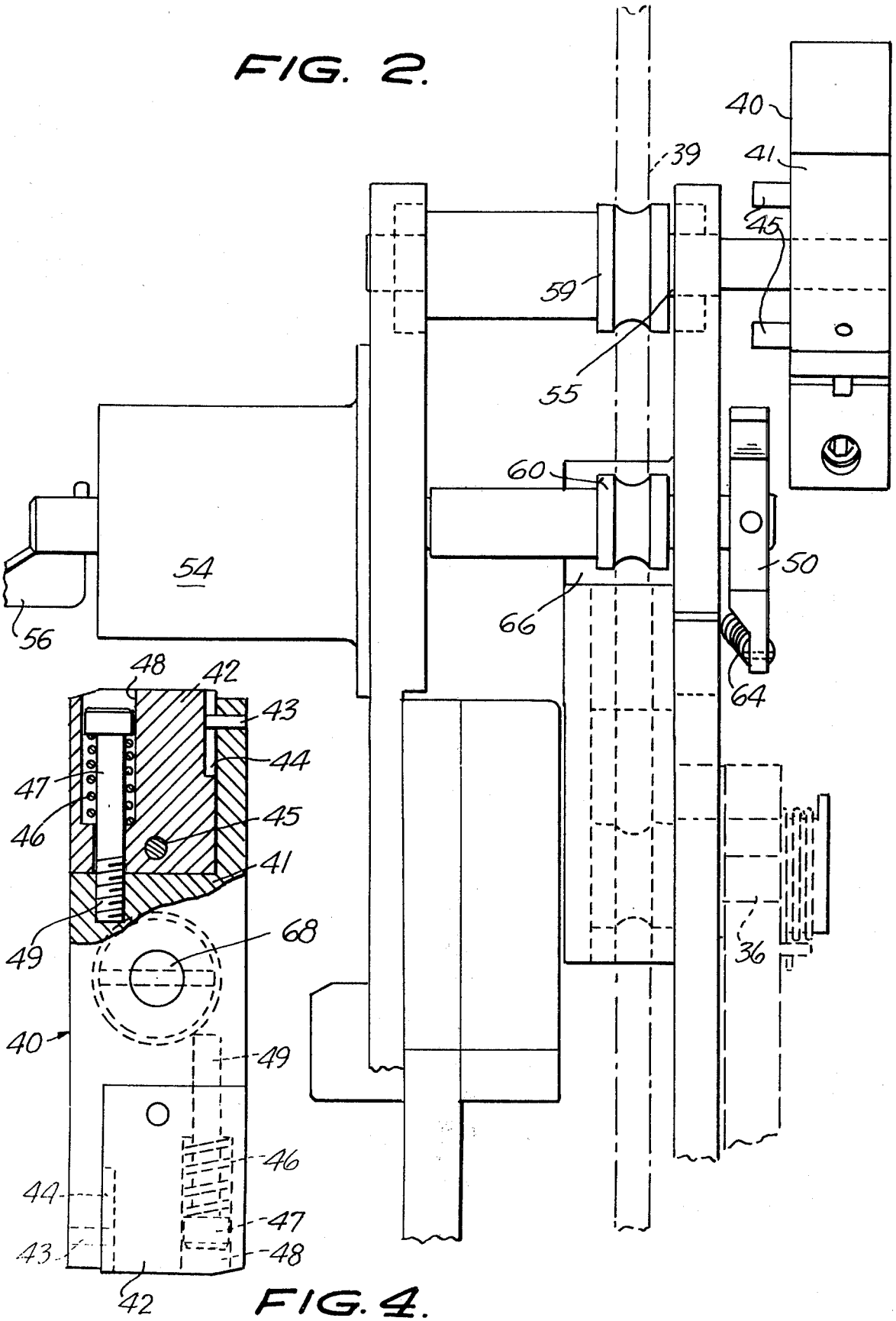
FIG. 2 is a view taken generally at right angles to the view shown in FIG. 1.
FIG. 4 is an enlarged elevational view illustrating certain constructional details of the overspeed sensor assembly, and with parts broken away and in section.

In accordance with the present invention there is provided an overspeed sensor assembly that is indicated generally by the numeral 40, and the overspeed sensor assembly 40 includes a bar 41 that has a pair of weights 42 adjustably connected thereto, FIG. 4. Pin members 43 engage slots or recesses 44 in the weights 42 for limiting outward movement of the weights 42. As shown in the drawings spring members 46 are circumposed on pins or screw members 47 for maintaining the parts in their proper position, and the screw members 47 have portions thereof arranged in recesses 48 in the weights 42, and the inner ends of the screw members 47 are arranged in threaded engagement as at 49 with the intermediate portion of the bar 41. Trip pins 45 are connected to the weights 42 for a purpose to be later described. A cam restraint arm 50 is selectively engaged by the pins 45 when the weights 42 move outwardly.

Rollers 59' and 59'' selectively engage the cable 39. A deadman switch lever 58 is mounted on the shaft 36 for rotating the shaft 36.

Figure 3:
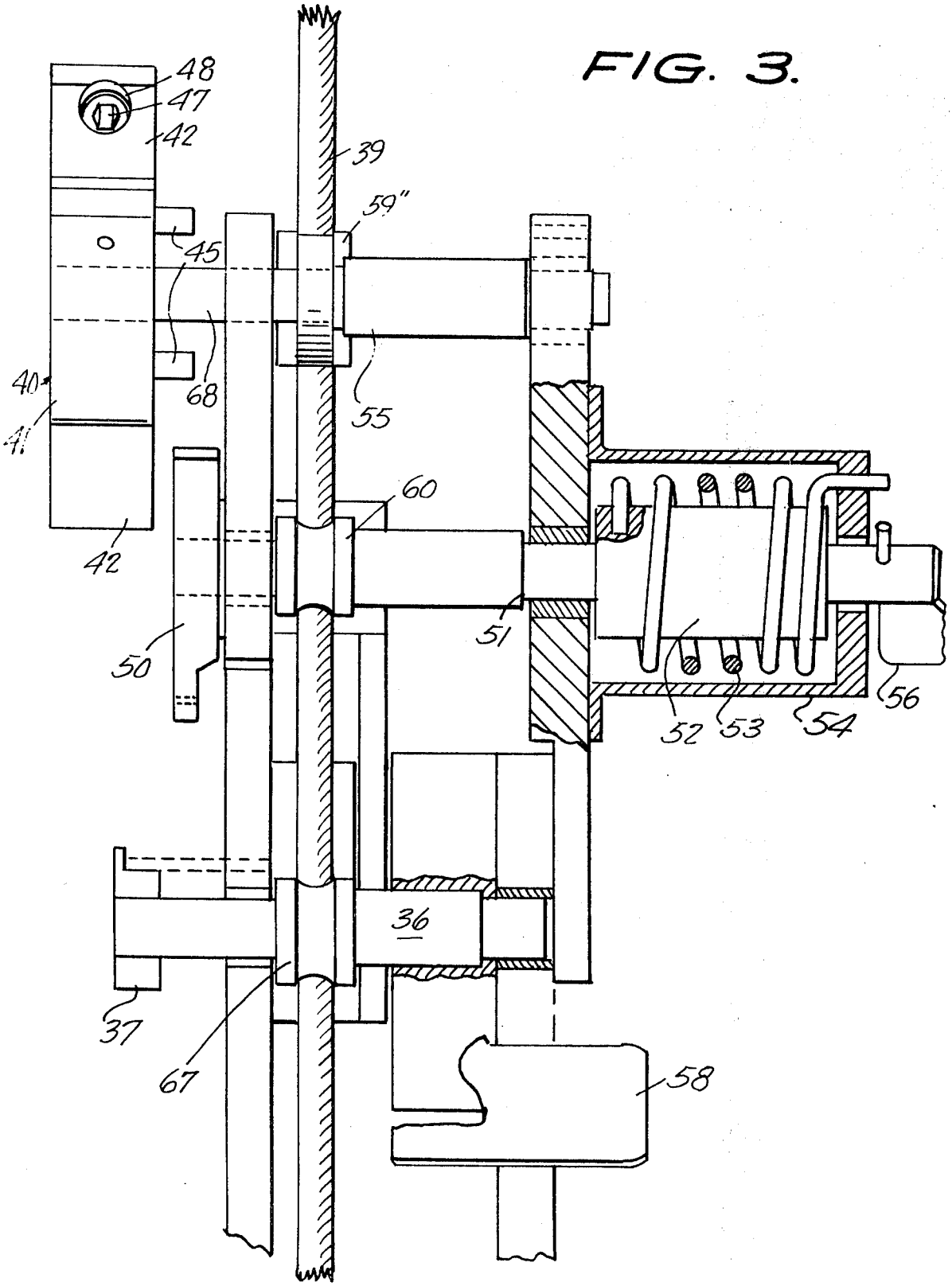
FIG. 3 is an elevational view, with parts broken away and in section, looking in the opposite direction from the view shown in FIG. 2.

Cam restraint arm 50 is attached to the outer end of a shaft 51 which extends horizontally through the unit (FIG. 3). Near the opposite end of shaft 51 from arm 50 there is an enlarged collar 52 with a torsion spring 53 circumposed thereon, collar 52 and spring 53 being enclosed on a housing 54. On the outer end of shaft 51, and outside of housing 54 there is a rotatable thumb lever 56, the operation of which will be disclosed hereinafter. Also mounted on shaft 51, and in close proximity with cable 39, there is a roller 60.

As shown in FIG. 1 a portion of the pawl 37 engages the pin 61 that is mounted for travel or movement in a slot or groove 62.

The movement of the pawl 37 is controlled by the handle or lever 58 to cause the teeth 38 to selectively engage the gear 33 whereby several effects are brought about, namely this causes rotation of the shaft 36 so as to move its cam roller 67 towards the rope or cable 39, and it also simultaneously lifts the wedge of the locking mechanism up to squeeze the cable. In addition with the teeth 38 engaging the teeth of the gear 33, the gear 33 will be prevented from turning or rotating.

The present invention is constructed so that in the event of a failure in any of the parts for any reason and with the device moving down the stationary cable 39, a secondary brake mechanism is provided. It will be noted that the cable 39 runs or passes between the pair of pulleys 59 in the secondary brake mechanism. One of these pulleys 59 is secured to the sensor assembly 40, and this roller that is secured to the sensor 40 is indicated by the numeral 59' while the other roller is indicated by the numeral 59''. Thus, as the unit starts to pick up speed and moves too quickly down the cable 39, the weights 42 are rotated and the weights 42 move outwardly relative to the bar 41 to cause the pins 45 to eventually hit the latch or arm 50 so that the arm 50 will be moved in a clockwise direction out of engagement with the cam 63, the arm 50 having a spring member 64 connected thereto for urging or biasing the parts in the proper direction, FIG. 1. When the pin 45 is released from the arm 50, the parts are returned to a position such as that shown in FIG. 1.

As soon as the arm 50 is knocked away from the cam 63 the shaft 65 for the cam 63 starts rotating in a counter clockwise direction, and the shaft 65 has a grooved pulley 60 thereon. The shaft 65 has a grooved pulley or roller 60 thereon so that as this member rotates it will bind the cable against the side of block 66, FIG. 2 so that a clamping action is affected between the rollers 60 and the block 66.

The pair of rollers 59' and 59'' are driven rollers and serve to rotate the respective shaft as the device goes up and down the cable 39.

It will be noted that there is provided a pair of the shafts 68 and 55 which have the rollers 59' and 59'' respectively thereon. The shaft 68 has the sensor assembly 40 connected thereto as shown in the drawings.

It is to be understood that the parts can be made of any suitable material and in different shapes and sizes as desired or required.

It will therefore be seen that there has been provided a cable climber secondary overspeed brake, and the unit is constructed so that it incorporates the present cable lock block into a double lock assembly by extending the block upward. The top portion of the block has the two rollers 59' and 59'' at the top with one of the rollers 59'spring loaded by the torsion spring 57 that compresses the cable 39 between the two rollers 59' and 59''.

This serves to drive the one pulley by its movement on the cable 39 which turns the overspeed sensor assembly 40, that is it serves to drive the pulley 59'. The sensor assembly 40 consists of the bar 41 with the two weights 42 whose movement is restricted by compression springs 46. These weights 42 move outwardly only at an overspeed condition, and these weights 42 have pins 45 that will trip an arm 50 when the weights 42 move outward which in turn allows the cam 60'' that is spring loaded by the torsion spring 53 to cause the cam 60'' to compress the cable 39 against a brake block 66. Any climber movement downward causes the cam to compress against the cable stopping the climber from moving any further.

Having thus described the preferred embodiment of the invention it should be understood that numerous structural modifications and adaptations may be re-sorted to without departing from the spirit of the invention.

What is claimed is:

1. In a secondary overspeed brake for a cable climber, motor means, a gear drive mounted on said motor means, a pinion connected to said drive and rotated thereby, a ring gear having said pinion arranged in meshing engagement therewith, a shaft having said ring gear fixedly mounted thereon, a second shaft member having a pawl on one end thereof, said pawl having teeth on an end thereof adjacent said ring gear, a cable, an overspeed sensor assembly comprising a bar, means actuated by said cable for rotating said bar, a pair of weights radially moveably mounted and adjustably connected to said bar, said weight moving outwardly at an overspeed condition, resilient means for restricting outward movement of said weights, pins connected to said weights, a cam adapted to engage said cable to lock said climber against movement on said cable, torsion spring means for rotating said cam into locking engagement with said cable, and a cam restraint arm selectively engageable by said pins when the weights move outwardly to release said cam so that the torsion spring causes the cam to lock the cable.

2. The structure as defined in claim 1 wherein said resilient means comprises compression springs.

3. The structure as defined in claim 2 and further including slots in said weights, and guide pins engaging said slots.

* * * * *